US008661741B2

(12) United States Patent
Hohmann, Jr.

(10) Patent No.: US 8,661,741 B2
(45) **Date of Patent: *Mar. 4, 2014**

(54) CHANNELED MASONRY FLASHING

(75) Inventor: Ronald P. Hohmann, Jr., Hauppauge, NY (US)

(73) Assignee: Mitek Holdings, Inc., Wilmington (DE)

( * ) Notice: Subject to any disclaimer, the term of this patent is extended or adjusted under 35 U.S.C. 154(b) by 0 days.

This patent is subject to a terminal disclaimer.

(21) Appl. No.: 13/285,805

(22) Filed: Oct. 31, 2011

(65) Prior Publication Data

US 2012/0042582 A1 Feb. 23, 2012

Related U.S. Application Data

(62) Division of application No. 11/607,234, filed on Dec. 1, 2006, now Pat. No. 8,046,956.

(51) Int. Cl.
*E02D 19/00* (2006.01)

(52) U.S. Cl.
USPC ..... 52/62; 52/169.5; 52/302.6; 52/302.1; 442/38; 428/40.1; 428/349

(58) Field of Classification Search
USPC ..... 52/60, 62, 169.5, 302.6, 302.3, 310, 52/378, 379, 302.1, 513; 428/40.1, 347, 428/348, 349, 355 R; 442/38, 43, 149
See application file for complete search history.

(56) References Cited

U.S. PATENT DOCUMENTS

| | | | |
|---|---|---|---|
| 2,499,908 | A | 5/1950 | Figge |
| 3,654,765 | A | 4/1972 | Healy et al. |
| 4,039,364 | A | 8/1977 | Rasmussen |
| 4,239,795 | A | 12/1980 | Haage |
| 4,295,911 | A | 10/1981 | Haage |
| 4,745,716 | A | 5/1988 | Kuypers |
| 4,755,409 | A | 7/1988 | Harkness |
| 4,775,567 | A | 10/1988 | Harkness |
| 4,840,515 | A | 6/1989 | Freese |
| 4,910,931 | A | 3/1990 | Pardue |
| 4,943,185 | A | 7/1990 | McGuckin et al. |
| 5,106,447 | A | 4/1992 | DiRado et al. |
| 5,349,792 | A | 9/1994 | Bayes |
| 5,511,346 | A | 4/1996 | Kenworthy |
| 5,545,276 | A | 8/1996 | Higgins |
| 5,598,673 | A | 2/1997 | Atkins |

(Continued)

OTHER PUBLICATIONS

Edward M. Petrie, Adhesion to Concrete Substrates, www.specialchem4adhesives.com, May 9, 2006, 8 pages.

(Continued)

*Primary Examiner* — Robert Canfield
*Assistant Examiner* — Jessie Fonseca
(74) *Attorney, Agent, or Firm* — Silber & Fridman

(57) ABSTRACT

A masonry flashing for use in a cavity wall is disclosed. The flashing has channels for draining water from the cavity while permitting entry of air into the cavity. The top surface of the flashing is covered by a protective member. The protective member is a scrim or, in the extruded form, an overarching portion of the flashing material. The protective member prevents the clogging of channels from mortar droppings and other construction debris. The flashing is shown with a drip edge is formed by extending the flashing beyond the external surface of the outer wythe and, with the edge being foil lined, manually forming the drip edge. A peel-and-stick embodiment described herein utilizes clear, nondrooling adhesives. Flashing accessories, namely, an end dam, an inside corner and an outside corner are also described.

7 Claims, 10 Drawing Sheets

(56) References Cited

U.S. PATENT DOCUMENTS

| | | | |
|---|---|---|---|
| 5,615,525 | A | 4/1997 | Kenworthy |
| 5,630,299 | A | 5/1997 | Jackman et al. |
| 5,692,348 | A | 12/1997 | Ambrosino |
| 5,815,986 | A | 10/1998 | Laska |
| 5,819,478 | A | 10/1998 | Bayes |
| 5,860,259 | A | 1/1999 | Laska |
| 5,870,864 | A | 2/1999 | Snyder |
| 6,023,892 | A | 2/2000 | Sourlis |
| 6,035,582 | A | 3/2000 | Pacific |
| RE36,676 | E | 5/2000 | Sourlis |
| 6,224,700 | B1 | 5/2001 | Oakley |
| 6,235,365 | B1 | 5/2001 | Schaughency et al. |
| 6,256,955 | B1 | 7/2001 | Lolley |
| 6,584,746 | B1 | 7/2003 | Hohmann et al. |
| 6,662,504 | B2 | 12/2003 | Krogstad |
| 6,684,579 | B2 | 2/2004 | Brunson et al. |
| 6,691,472 | B2 | 2/2004 | Hubert |
| 6,777,053 | B1 | 8/2004 | Gunter |
| 6,928,780 | B1 | 8/2005 | Hohmann |
| 6,945,000 | B1 | 9/2005 | Hohmann |
| 6,964,136 | B2 | 11/2005 | Collins et al. |
| 6,990,775 | B2 | 1/2006 | Koester |
| 7,017,318 | B1 | 3/2006 | Hohmann |
| 7,131,788 | B2 | 11/2006 | Ianniello et al. |
| 2002/0115367 | A1 | 8/2002 | Lolley et al. |
| 2003/0215594 | A1 | 11/2003 | Hamdar et al. |
| 2003/0230035 | A1 | 12/2003 | Collins |
| 2004/0003558 | A1 | 1/2004 | Collins |
| 2005/0028455 | A1 | 2/2005 | Koch |
| 2005/0097861 | A1 | 5/2005 | Schroer et al. |
| 2005/0204656 | A1 | 9/2005 | Baba |
| 2005/0210787 | A1 | 9/2005 | Koester |
| 2006/0117687 | A1 | 6/2006 | Ehrman |
| 2006/0283102 | A1 | 12/2006 | Sourlis |

OTHER PUBLICATIONS

Morter Net USA Ltd., Totalflash, Cavity-wall drainage system, http://mortarnet.com/tf/index.htm, 2 pages.

CHANNELED MASONRY FLASHING

CROSS-REFERENCES TO RELATED APPLICATIONS

This application is a divisional of U.S. Pat. No. 8,046,956 entitled CHANNELED MASONRY FLASHING, issued Nov. 1, 2011, which Patent is incorporated herein by reference.

BACKGROUND OF THE INVENTION

1. Field of the Invention

This invention relates to an improved flashing system for cavity wall structures. More specifically the invention relates to channeled flashings having protected channels, which channels are protected from being clogged by mortar and construction debris. The flashings are designed for mounting with an open end of the channel in communication with the exterior of the cavity wall and the protected channel in the cavity to enable the channel to operate as a conduit between the cavity and the exterior.

2. Description of the Prior Art

In the past, investigations relating to cavity wall flashing systems for brick veneer masonry construction have been conducted. While strides have been made in flashing-related technologies, including metal foils, polymeric and elastomeric materials and hot melt adhesives, there still remain several areas where continued development is ongoing. The inventors' patents and their assignee's product line are all related to accessories for cavity wall structures and include masonry flashing, insulation, and anchoring and seismic devices, and are sold under the trademarks of Seismiclip®, Byna-Tie®, and DW-10-X®, X-Seal®, Foam Tech®, and FlexFlash™. These products, which are manufactured by Hohmann & Barnard, Inc., Hauppauge, N.Y. 11788, have become widely accepted in the construction industry and have provided the inventors with particular insight into the technological needs of this marketplace.

Masonry walls with brick veneer are designed with an inner and an outer wythe and a cavity therebetween. The backup wall or inner wythe and insulation thereon isolates the interior of the building from the environment, and the brick veneer outer wythe provides an aesthetic finish to the building and a system of weep holes for removing fluids from the cavity. The inner wythe is constructed to exclude water and water vapor from the interior. Where excessive levels of water or water vapor are present in the cavity, the deterioration of building materials is hastened. Various masonry flashing systems in the past have been adopted to function cooperatively with the system of weep holes.

In the past, protective systems have been devised to prevent the blockage of weep holes by excess mortar and construction debris which fall into the cavity during construction. Of note in this regard is the MORTAR NET system developed by Tom Sourlis and described in U.S. Pat. Nos. 5,230,189, RE.36, 676, and 6,023,892. Other examples of such systems provided by U.S. Pat. No. 6,684,579 B2 issued to Brunson et al.; U.S. Pat. No. 5,692,348 issued to Ambrosino; U.S. Pat. No. 6,256,955 issued to Lolley; U.S. Pat. No. 5,598,673 issued to Atkins; and, U.S. Pat. No. 5,860,259 issued to Laska. More recently systems have been described in U.S. Patent Applications 2004/0003558 A1 and 2003/0230035 A1 of Collins et al. and U.S. Patent Application 2006/0117687 of Ehrman et al.

Because of widespread usage and familiarity with bituminous and asphaltic products in roofing applications, when masonry flashing systems were first designed, the building construction industry adopted the familiar copper and asphalt products. At that time the technology of pressure-sensitive hot melt adhesives needed for peel-and-stick applications was insufficiently developed. Some critics indicated that the tackiness of the non-asphaltic products was insufficient for the rough masonry block surfaces.

Because of the presence of plasticizers, others were apprehensive about the available hot melt adhesives meeting the requisite fire retardancy standards. Also, to provide fire retardancy, some pressure-sensitive products were marketed for building construction use with inorganic fillers, such as alumina trihydrate, antimony oxide or calcium carbonate. However, these filled pressure-sensitive products had disadvantages, such as application problems, phase separation, toxicity, and reduced adhesion upon activation.

The inventors hereof have in inventions related hereto made improvements in the masonry flashing art. Hohmann et al. U.S. Pat. Nos. 6,584,746 issued Jul. 1, 2003; 6,928,780 issued Aug. 16, 2005; and, 6,945,000 issued Sep. 10, 2005 provide masonry flashing systems which are suitable either for surface-mounting with a termination bar or for through-wall mounting. The devices use state-of-the-art adhesives and various flashing membranes and composites.

A published patent application, namely, U.S. Patent Application 2005/0028455 of Koch et al. describes a combination flashing and drainage system. The system described uses a layer of polypropylene or equivalent as a wicking material to transport water. As wicks are hydrophilic, water is moved from wetter to drier areas of the wick and are reversible. The Koch et al. system relies on evaporation at the outer exterior edge thereof to reduce the total water content.

In preparing for this application the below-mentioned patents, some of which are discussed above, came to the attention of the inventors. The other patents are believed to be relevant to the further discussion of the prior art, which follows:

| Patent | Inventor | Issue Date |
|---|---|---|
| 6,945,000 | Hohmann et al. | Sep. 20, 2005 |
| 6,928,780 | Hohmann et al. | Aug. 16, 2005 |
| 6,684,579 | Branson et al. | |
| 6,584,746 | Hohmann et al. | Jul. 1, 2003 |
| 6,256,955 | Lolley | |
| 6,224,700 | Oakley | May 1, 2001 |
| 6,035,582 | Pacific | Mar. 14, 2000 |
| 5,870,864 | Snyder | Feb. 16, 1999 |
| 5,860,259 | Laska | Jan. 19, 1999 |
| 5,692,348 | Ambrosino | |
| 5,598,673 | Atkins | |
| 4,910,931 | Pardue | Mar. 27, 1990 |
| 4,775,567 | Harkness | Oct. 4, 1988 |
| 4,755,409 | Harkness | Jul. 5, 1988 |
| 4,295,911 | Haage et al. | Oct. 20, 1981 |
| 4,239,795 | Haage et al. | Dec. 16, 1980 |

PUBLISHED PATENT APPLICATIONS

| Pat. Application | Inventor |
|---|---|
| 2004/0003558 A1 | Collins et al. |
| 2003/0230035 A1 | Collins et al. |
| 2006/0117687 | Ehrman et al. |

U.S. Pat. No. 6,224,700—Oakley—Issued May 1, 2001
Oakley in U.S. Pat. No. 6,224,700 (assigned to Mar-Flex Systems, Inc., Middletown, Ohio) describes a method of applying a composite material to an above-grade building component to form a tacky non-swelling elastomeric membrane. Thereafter, a flexible, non-porous polymeric sheet is pressed onto the tacky exterior of the elastomeric membrane. The polymeric sheet is stronger than the elastomeric membrane and protects the elastomeric membrane from punctures or tears. Here, in situ construction is both labor intensive and requires special equipment for installation.

U.S. Pat. No. 6,035,582—Pacific—Issued Mar. 14, 2000
Pacific describes a flashing material which includes a sheet layer of copper, aluminum or other metal or a thin sheet of unreinforced plastic. Here it appears that in situ adhesives are applied.

U.S. Pat. No. 5,870,864—Snyder—Issued Feb. 16, 1999
Snyder describes a drainage system employing water collection pans which for insertion into the interior cavities of masonry block units over the length of a selected block wall course for collecting the water drained through the interior cavities of the upper courses and directing water to the exterior of the wall.

U.S. Pat. No. 5,860,259—Laska—Issued Jan. 19, 1999
Laska describes an insulated drainage panel for use in cavity wall or veneer wall construction which panel includes a planar insulating board with a porous structure thereof.

U.S. Pat. No. 4,910,931—Pardue—Issued Mar. 27, 1990
In the Pardue patent, a water collection and drainage system is described for a masonry block wall having bond beam block courses and intervening standard block courses. A system of upper water collection pans is supported along each upper bond beam course. Downspouts leading from drain openings in the upper collection pans drain collected from the pans through the vertical block cavities in lower block courses to the next lower series of collection pans. Weeping spouts lead laterally from the base collection pans to the exterior of the wall to continuously drain collected water from the interior wall cavities.

U.S. Pat. Nos. 4,775,567 and 4,755,409—Harkness—issued Oct. 4, 1988 and Jul. 5, 1988, Respectively.
A waterproofing laminate suitable for use in roofs, floors or other surfaces where waterproofing is desired contains a reinforcing sheet, first and second bitumen layers secured to opposite surfaces of the reinforcing sheet, first and second compound bitumen layers secured to the bitumen layers, an elastomeric sheet secured to the first compound bitumen layer and a release sheet secured to the second compound bitumen layer. Certain preferred materials for use in the laminate are recited.

U.S. Pat. Nos. 4,295,911 and 4,239,795—Haage et al.—Oct. 20, 1981 and Dec. 16, 1980, Respectively.
A protective covering for the protection of surface seals against mechanical damage in building constructions and other civil engineering constructions which comprises a composite of an elastic, waterproof thermoplastic synthetic resin film sheet and/or synthetic resin layer and a lattice-like fabric having knot couplings or points of intersection of the threads that yield under the effect of a load.

The channeled masonry flashings of this invention include a selected group of flashing membranes which are transversely channeled by processes including embossing, creping or corrugating, and extrusion. The flashings are optionally surface- or through-wall mounted with clear, pressure-activated adhesive thereon. With the addition of a release sheet atop the optional adhesives, these flashings become labor-saving peel-and-stick devices readily mounted in the cavity between the inner wythe and the outer wythe as described infra. Additionally, one embodiment hereof includes a metal foil drip edge, and, in another, the adhesive layer has been doped with fibrous material to increase the overall strength of the construct. The structure of this invention has been found to obviate the difficulties discussed above and among advantages as set forth herein, provides for a combined flashing and mortar and debris protection device with attributes not found, nor taught toward, in the prior art.

SUMMARY

In general terms the channeled masonry flashing of this invention provides a device combining the functions of draining water from a cavity wall, permitting the entry of air thereinto, and collecting mortar and construction debris in a manner that prevents the blockage of the drain. This is accomplished utilizing a flexible flashing membrane with channels in the top surface that are covered by a protective member. When a pressure-activated adhesive is added to the bottom surface together with a release sheet thereover, a peel-and-stick assemblage is formed. This facilitates a labor-saving application of the multi-functional device.

The description which follows is of four embodiments suggesting the best mode of practicing the invention. The embodiments utilize a broad range of suitable flexible flashing membranes, which include, but are not limited to, elastomers—such as DuPont's Elvaloy® material and ethylene propylene dienemethylene terpolymer (EPDM); and, polymers—such as high-density polyethylene (HDPE). Other materials are suggested hereinbelow. The channels in the flashing membranes are variously formed by embossing, creping or corrugating, and extrusion and are transverse to the longitudinal axis of the elongated membrane. The channels act as conduits between the cavity of the wall and have openings at the exterior surface of the outer wythe.

The channeled masonry flashing in the peel-and-stick form includes inter alia a hot melt adhesive. The various embodiments utilize various adaptations of the basic formulation and include clear adhesives and adhesives with additives. All the adhesives meet flammability standards and are resistive to wide swings in ambient temperatures. This precludes drooling of the adhesives and the concomitant marring of exterior wall surfaces. In one embodiment using creped HDPE, the adhesive layer is doped with fiber glass or polyethylene fiber fragments. In applications in which the channeled masonry flashing is adhered to a porous masonry block backup wall, the tackifier resin content is optionally increased.

In lieu of a separate drip plate, a foil lamina or an edge treatment is provided to overcome the memory of the flashing membrane. When this is incorporated into the structure, the channeled masonry flashing is installed so as to extend slightly beyond the plane of the exterior surface and the extension is manually bent downward and outward. This formed edging allows any draining fluid to avoid the building surface. The channeled masonry flashing as summarized above replaces with single application several previously used building components.

OBJECTS AND FEATURES OF THE INVENTION

It is an object of the present invention to provide for cavity wall construction a combined high-strength masonry flashing and a mortar and construction debris collection device.

It is a further object of the present invention to provide for surface- or through-wall-mounting to the inner wythe a peel-and-stick channeled flashing membrane having a pressure-activated, clear adhesive thereon which, upon removal of a release sheet and application of pressure thereto, strongly adheres to the rough and porous surfaces of the backup wall and the brick.

It is another object of the present invention to provide in a masonry flashing for cavity wall construction, combining clear hot melt adhesive and flashing membrane in a device free of bituminous or asphaltic coatings, which flashing resists drooling, tearing and puncturing.

It is yet another object of the present invention to provide a labor-saving masonry flashing which utilizes peel-and-stick components that are easy and economical to install in cavity wall constructs having a masonry block or drywall inner wythe and a brick or veneer outer wythe.

It is still yet another object of the present invention to provide a masonry flashing which has a built-in mortar protective member and drip edge and thus does not require the installation of separate flashing accessories such as mortar guards and weep hole fittings.

It is a feature of the present invention that the channeled flashing hereof provides for drainage from the cavity and permits the entry of air thereinto.

It is another feature of the present invention that the flashing membrane hereof is highly, ultraviolet resistant and the adhesive layer of the flashing enhances tear and puncture resistance of the overall structure and meets industry flammability standards.

It is yet another feature of the present invention that when the overall strength of the flashing is enhanced by a hot melt adhesive doped with fibrous reinforcement, the adhesive formulation is adjustable to maintain the tackiness required for bonding of the flashing with the inner wythe.

It will become apparent that these aims and other objects and features are best achieved by a channeled masonry flashing for a cavity wall described in detail hereinbelow.

BRIEF DESCRIPTION OF THE DRAWINGS

In the following drawings, the same parts in the various views are afforded the same reference designators.

DESCRIPTION OF THE PREFERRED EMBODIMENTS

In the channeled masonry flashings of this invention, flexible membranes are described. The channels are sulcated into the membranes by any of a number of processes including, but not limited to, embossing, corrugating or creping, and extruding. The channels are protected from blockage by excess mortar and construction debris by a protective member such as a scrim or mesh-like body. In the embodiment describing an extruded flashing membrane, the protective member is in the form of channel wall extensions overarching the channel bed. The channels are transverse to the longitudinal axis of the membrane and provide a conduit for draining water from the cavity to the exterior and allowing air to enter the cavity.

By adding pressure-activated adhesives and release sheets to the flashings, peel-and-stick assemblages are formed, which assemblages enable surface- and through-wall-mounting with a substantial saving of labor. The adhesives employed are state-of-the-art, clear, hot-melt adhesives with formulations that are highly adaptable to the various field uses. Exemplary of the adaptability is that the tackiness of the hot melt adhesive formulation employed is adequate for flashing installation on drywall and on masonry block. Further, when a fibrous material is added to the adhesive to strengthen the overall construct, the tackifier additive is increased to retain the bonding characteristic.

Figure 1:
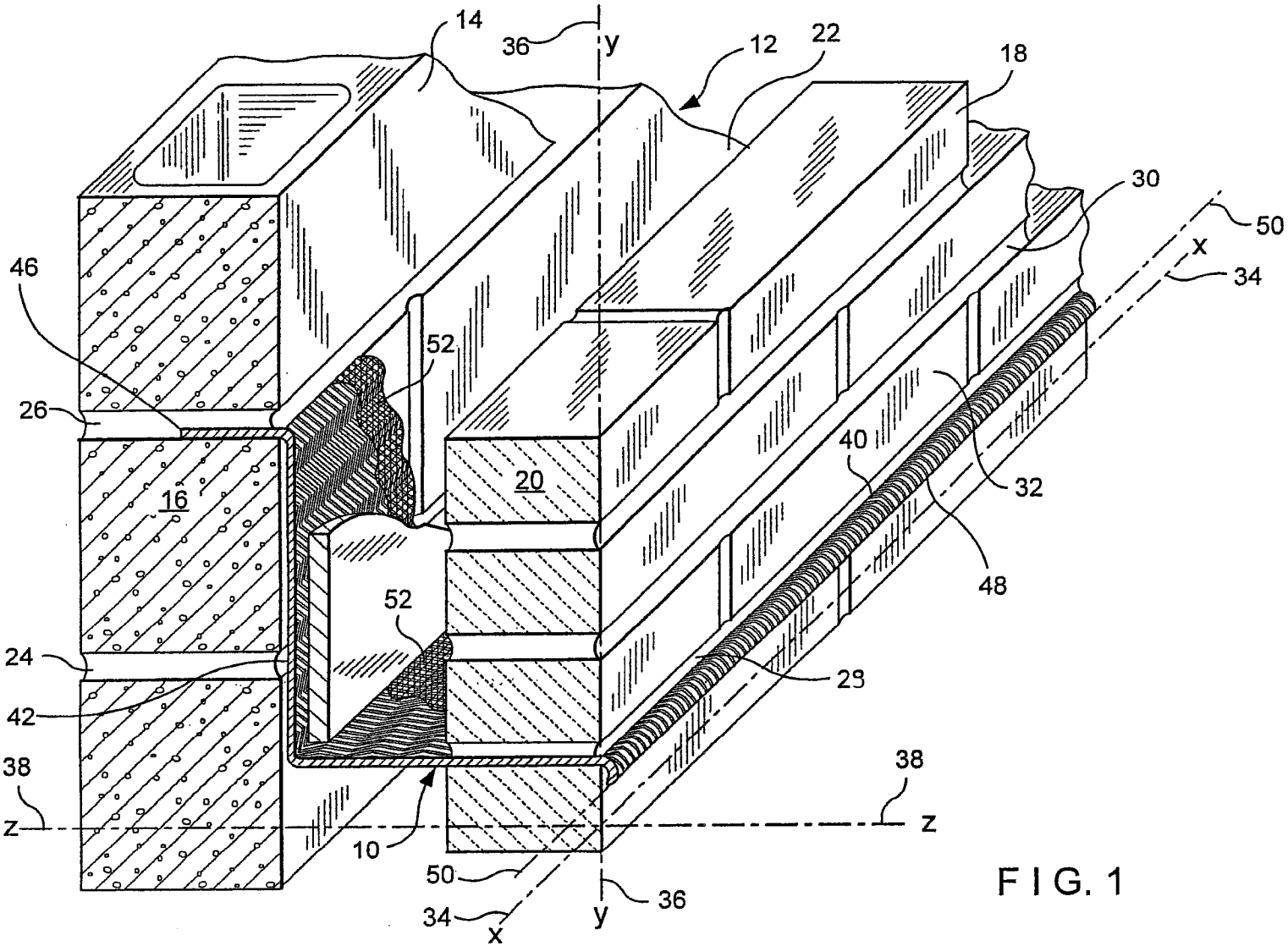
FIG. 1 is a perspective view of a first embodiment of a channeled masonry flashing of this invention and shows a cavity wall with an interior wythe of masonry block and an exterior wythe of brick having a through-walled-mounted flashing membrane installed in the cavity thereof.
Figure 2:
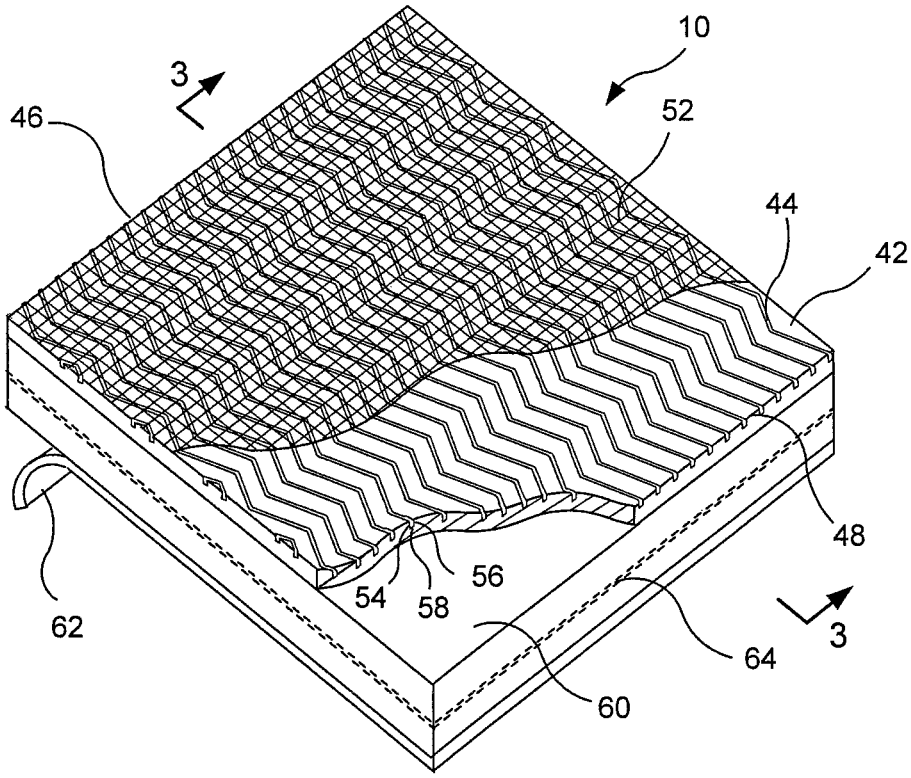
FIG. 2 is a perspective view of the embossed Elvaloy® channeled flashing membrane of FIG. 1 with a scrim thereon shown partially broken away.
Figure 3:
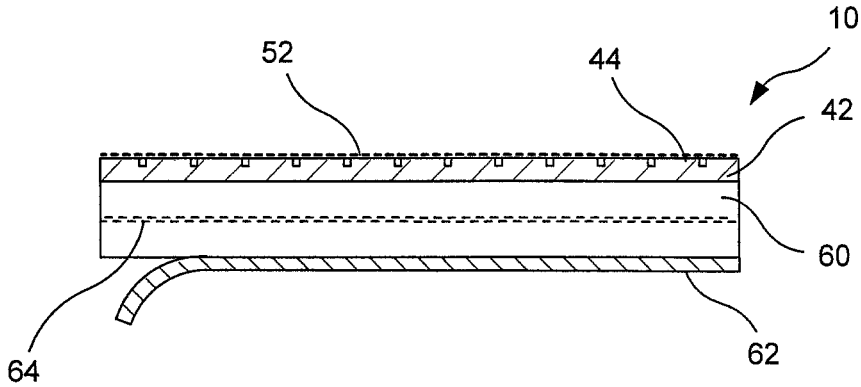
FIG. 3 is a cross-sectional view taken along lines 3-3 of the channeled flashing membrane of FIG. 2 with an adhesive layer and release sheet added thereto and shows the drainage channel.

Referring how to FIGS. 1 through 3, the first embodiment of this invention in which a channeled flashing assembly or masonry flashing structure referred to generally by the reference designator 10 is shown. In this embodiment, a cavity wall structure 12 is shown having an inner wythe 14 of masonry blocks 16 and an outer wythe 18 of facing brick 20. Between the inner wythe 14 and the outer wythe 18, a cavity 22 is formed. Successive bed joints 24 and 26 are formed between courses of blocks 16 and the joints are substantially planar and horizontally disposed. Also, successive bed joints 28 and 30 are formed between courses of bricks 20 and the joints are substantially planar and horizontally disposed. For the through-wall-mounted flashing installation of this embodiment the flashing 10 is shown extending into bed joint 26 of the inner wythe 14 and through bed joint 28 of the outer wythe 18.

For purposes of this discussion, the exterior surface 32 of the outer wythe 18 contains a horizontal line or x-axis 34 and an intersecting vertical line or y-axis 36. A horizontal line or z-axis 38 also passes through the coordinate origin formed by the intersecting x- and y-axes. A horizontal line or z-axis 38 also passes through the coordinate origin formed by the intersecting x- and y-axes. In the discussion which follows, it will be seen that the channeled masonry flashing 10 of this invention is constructed to completely cover the lowermost portion of the cavity, to drain water therefrom and to permit air and water vapor to enter and exit through channel openings 40 of flashing membrane 42.

Referring now to FIG. 2 a perspective view of the channeled masonry flashing 10 is shown. A flexible membrane 42 is shown and is constructed from a sheet of Elvaloy® material in the 10- to 100-mil range. While the membranes hereof are described as elastomeric or polymeric materials other flexible webs, which might fall outside this classification may be used. The flexible membrane is embossed with channels 44 which extend from edge 46 at the inner wythe 14 to edge 48 at the exterior surface 32 of outer wythe 18. In this embodiment, the channels 44 terminate at exterior surface 32 of outer wythe 18 and are disposed transverse to longitudinal axis 50 of elongated flexible membrane 42.

As seen in FIGS. 1 through 3, the embossed flashing 42 has a scrim or protective member 52 disposed atop channel walls 54 and 56 for collecting mortar and construction debris dropped into the cavity and thereby preventing the blockage of the channels. The scrim or a mesh-like equivalent 52 is water permeable and allows water to drain along the channel beds 58 to the channel openings 40. Drainage is facilitated by, upon installation, slightly canting the flashing membranes 42 from back to front of cavity 22.

Referring again to FIG. 3 the channeled masonry flashing 42 is shown as a peel-and-stick product and further includes a hot melt adhesive layer 60 which is formulated for pressure activation and compatibility with the flashing membrane or web 42 and the release sheet 62 adhered thereto. The adhesives described herein are particularly useful for peel-and-stick applications in building construction industry as such adhesives are readily pressure activated after the release paper is removed.

The adhesive is formulated so that, in case of fire, the coatings thereof will not contribute to smoke or accelerate flame spreading. The adhesive layer 60 optionally includes an inorganic material, namely, an alkali-resistant fiber glass 64. This additive enhances the overall strength of the flashing system and provides multidirectional reinforcement. Alternative to being doped with the fiber glass additive 64, the flashing may be strengthened using polymeric fiber fragments. Also, the fiber-doped adhesive layer is formulated to have sufficient tackiness so that a durable bond between the membrane and the rough and porous surface of the masonry block is experienced. The adhesive on the flashing permits butting of the widths of flashing precluding the use of caulks and sealants at the joints. The joints can be further reinforced with sealing tape.

Incorporating by reference the Di Rado et al. patent, U.S. Pat. No. 5,106,447, the hot melt adhesive compositions of hot melt layer 60 may be prepared from 10 to 50 weight percent of a thermoplastic elastomer, namely, thermoplastic polybutene-1/ethylene copolymer containing from about 5.5 to about 10% by weight ethylene (polybutylene); 20 to 50 percent of a tackifier; 15 to 50 percent of an amorphous diluent having a softening point greater than 90 degrees C.; and, 0 to 2 percent of a stabilizer.

The polybutylene copolymers employed herein are copolymers of polybutene-1 and ethylene wherein the ethylene content varies from about 5.5 to about 10% weight of the copolymer. The applicable isotactic polybutylenes are relatively rigid while in their plastic form but flow readily upon being heated. Expressing molecular weight in terms of melt index, the applicable isotactic polybutylenes to be used in the present adhesive should exhibit a melt index in the range of from about 5 to 2000 dg/min and preferably from 400 to 700 dg/min. The latter melt flow values are determined by the method described in ASTM D1238 and are inversely related to molecular weight, i.e., the lower the melt index, the higher the molecular weight. These copolymers are available from Shell Chemical Company under the Duraflex trademark as Duraflex 8310, 8410, 8510, and 8910, with the 8910 having a melt index of about 700, a grade preferred for use herein. Mixtures of these copolymers may also be used.

The tackifying resins which may be used to extend the adhesive properties of the isotactic polybutylene include: (1) hydrogenated wood rosin or rosin ester; (2) polyterpene resins; (3) aliphatic petroleum hydrocarbon resins; and, (4) partially and fully hydrogenated hydrocarbon resins.

The polyterpene resins have a softening point, as determined by an ASTM method E28-58 T, of from about 80 degrees C. To 150 degrees C., the latter polyterpene resins generally resulting from the polymerization of terpene hydrocarbons in the presence of Friedel-Crafts catalysts at moderately low temperatures and including the latter resins which are aromatically modified; examples of commercially available resins of this type being the Nirez resins sold by Reichhold Chemical, the Zonatac resins sold by Arizona, and the Piccolyte S-10, S-25, S-40, S-85, S-100, S-115, S-125 and S-135 resins as sold by Hercules Chemical.

The aliphatic petroleum hydrocarbon resins have a Ball and ring softening point of from about 80 degrees C. To 160 degrees C., resulting from polymer-ization of monomers consisting primarily of 5 carbon atom olefins and diolefins, and including the latter resins which are aromatically modified, examples of commercially available resins of this type being Wingtack 95 and Wingtack Extra as sold by the Goodyear Tire and Rubber Company and the Escorez 1000 series of resins sold by the Exxon Chemical Corporation.

Examples of the partially and fully hydrogenated hydrocarbon resins are resins such as Resin H-130 from Eastman, Escorez 5000 series from Exxon, and Regalrez from Hercules. The amorphous diluents which are needed and present in the adhesive composition include (atactic) amorphous polypropylene or other similar high softening point (i.e. greater than 90 degrees C.), low crystalline diluent, (e.g. amorphous polyalpha-olefins). These diluents, are used at levels of 20 to 50% by weight, preferable about 20 to 25% by weight.

A suitable release paper is applied thereover. After a prescribed cure period, the release paper is removed and the flashing of this invention is applied to the surface of a concrete block. The application to the concrete block is at room temperature utilizing a hand-operated laminating roller to provide the pressure activation. A spring scale is then attached to the masonry flashing and a 65 lb. Force is required to peel the flashing from the block. Repeating the test for SBS-modified, peel-and-stick flashing, a force of 27 lb. (Max.) Is required to peel the flashing from the block.

Among the applicable stabilizers or antioxidants utilized herein are included high molecular weight hindered phenols and multifunctional phenols such as sulfur and phosphorous-containing phenols. Representative hindered phenols include: 1,3,5-trimethyl 2,4,6-tris (3,5-di-tert-butyl-4-hydroxy-benzyl)benzene; penta-erythrityl tetrakis-3 (3,5-di-tert-butyl-4-hydroxyphenyl) propionate; 4,4'methylenbis(2, 6-tert-butyl-phenol); 4,4'-thiobis (6-tert-butyl-o-cresol); 2,6-di-tertbutylphenol; 6-(4-hydroxy-phenoxy)-2,4-bis(n-octyl-thio)-1,3,5-triazine; di-n-octadecyl 3, 5-di-tert-butyl-4-hydroxy-benzylphosphonate; 2-(n-octylthio)-ethyl 3,5-di-tert-butyl-4-hydroxybenzoate; and sorbitol hexa [3-(3,5-di-tert-butyl-4-hydroxyphenyl)-propionate].

The performance of these antioxidants may be further enhanced by utilizing, in conjunction therewith known synergists such, for example, as thiodipropionate esters and phosphites. Particularly useful is distearylthiodipropionate. These stabilizers are generally present in amounts of about up to 2 weight percent, preferably 0.25 to 1.0%. Besides the glass fiber reinforcing agent mentioned above, other additives such as flow modifiers, pigments, dyestuffs, etc., which are conventionally added to hot melt adhesives for various end uses may also be incorporated in minor amounts into the formulations of the present invention.

Figure 4:
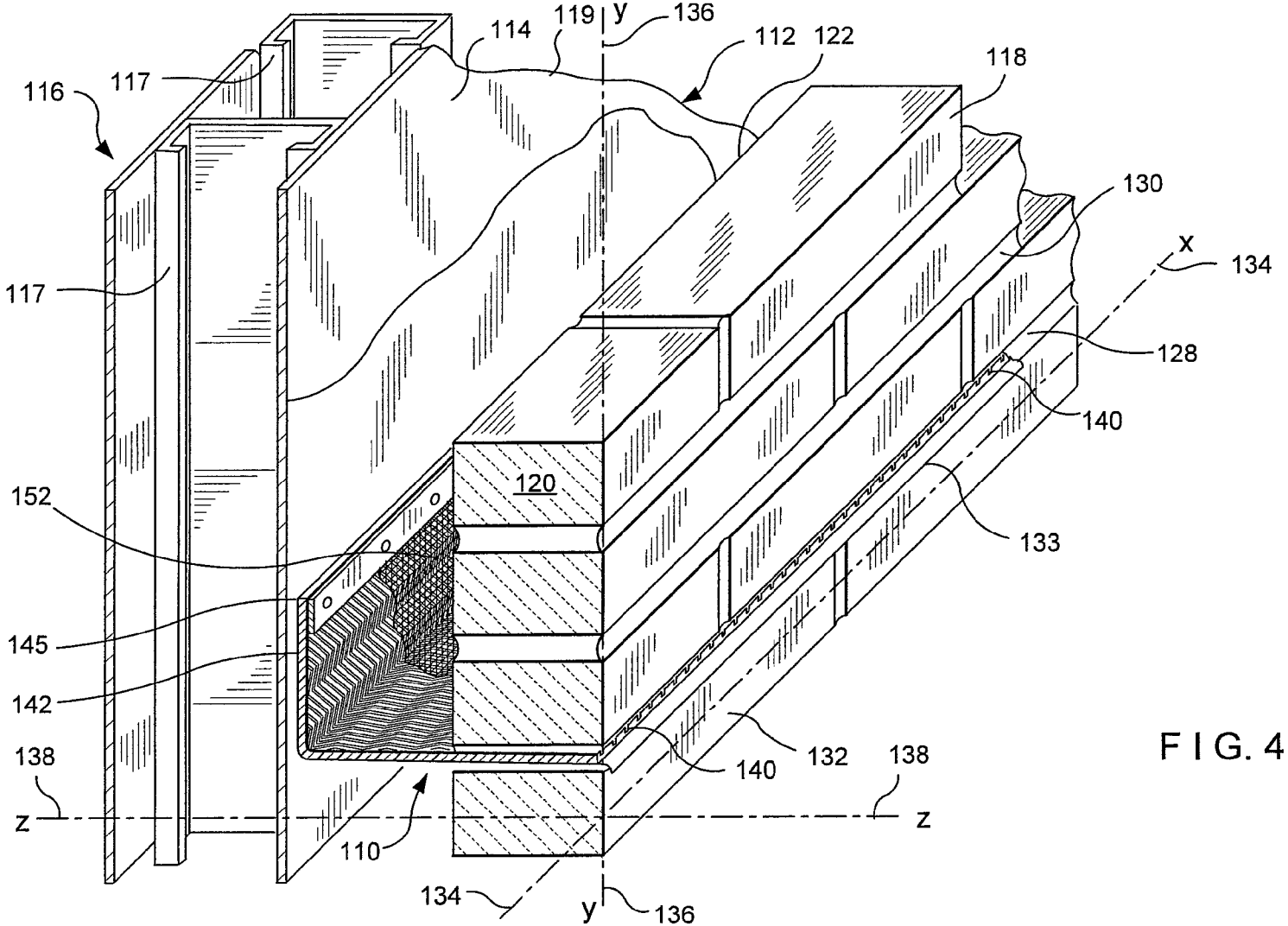
FIG. 4 is a perspective view of the second embodiment of a channeled masonry flashing of this invention and shows a cavity wall with an interior wythe of drywall construction and an exterior wythe of brick having a surface-mounted EPDM flashing membrane installed in the cavity thereof.
Figure 5:
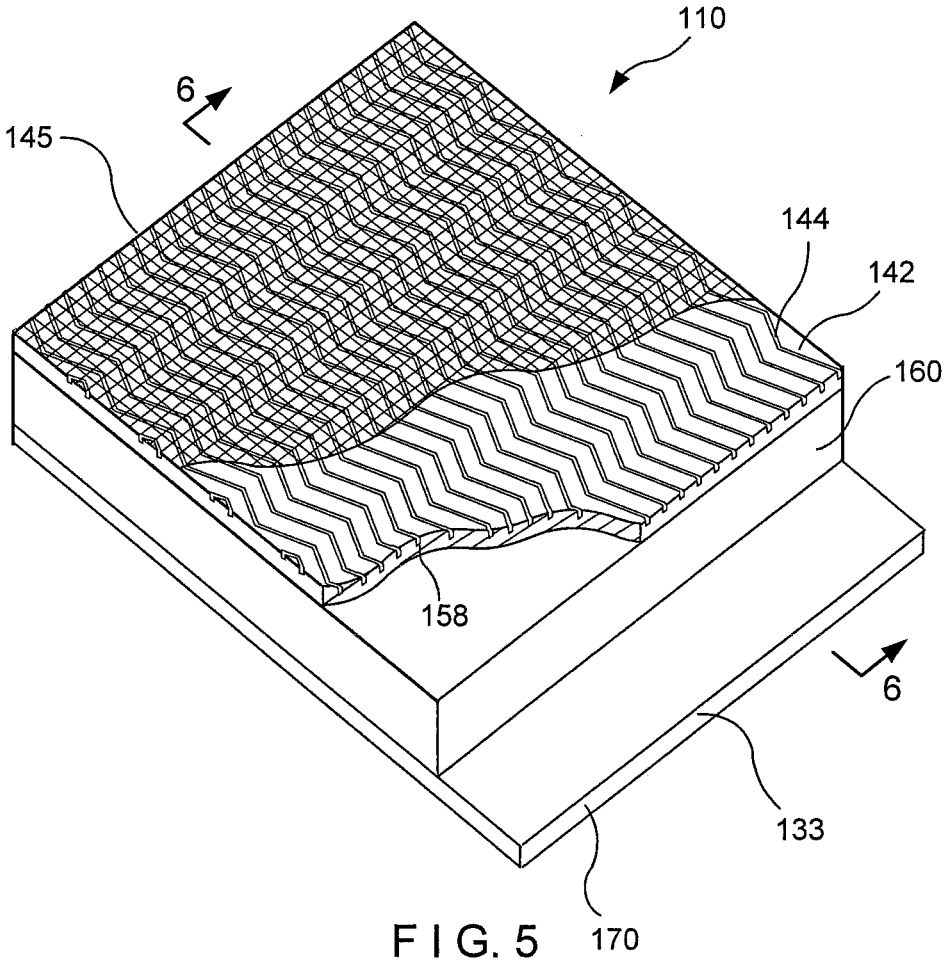
FIG. 5 is a perspective view of the uninstalled channeled flashing membrane of FIG. 4 showing an embossed elastomeric membrane with a scrim top and a metal foil backing.
Figure 6:
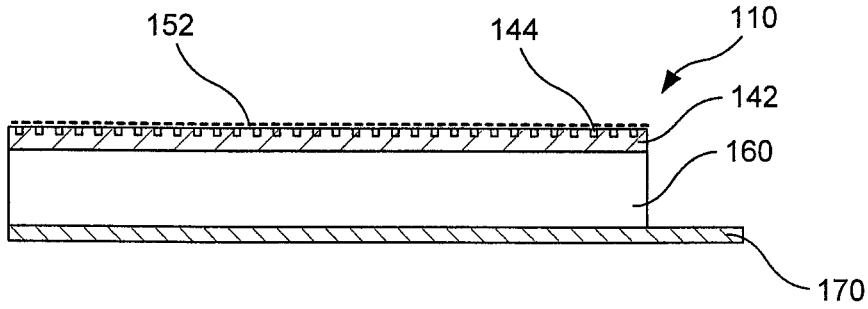
FIG. 6 is a cross-sectional view of the channeled flashing membrane of FIG. 5 with an adhesive layer and release sheet added thereto.

Referring now to FIGS. 4 through 6, the second embodiment of this invention in which a surface-mounted channeled masonry flashing, referred generally by the reference designator 110, is shown. In this embodiment, similar parts to those of the membrane of the first embodiment are referred to by reference designators 100 units higher than a similar part in the first embodiment. Thus, for example, the adhesive layer 60 in the first embodiment has an analogous adhesive layer 160 in the second embodiment.

In showing the additional embodiments hereof, this specification details alternative structures of the polymeric membrane and the adhesive layer. Although shown as specific assemblages, any of the membranes shown and described may optionally be employed with any of the adhesive layers. Thus, the embodiments are only exemplary of the scope of the invention.

In this embodiment, a cavity wall structure 112 is shown having an inner wythe 114 of drywall construction 116 and an outer wythe 118 of facing brick 120. The drywall construction 116 includes metal studs 117 with sheetrock or wallboard 119 thereover. Between the inner wythe 114 and the outer wythe 118, a cavity 122 is formed. Successive bed joints 128 and 130 are formed between courses of bricks 120 and joints are substantially planar and horizontally disposed. For the surface-mounted flashing installation of this embodiment the flashing 110 is shown extending up to inner wythe 114 and through bed joint 128 of the outer wythe 118.

For purposes of this discussion, the exterior surface 132 of the outer wythe 118 contains a horizontal line or x-axis 134 and an intersecting vertical line or y-axis 136. A horizontal line or z-axis 138 also passes through the coordinate origin formed by the intersecting x- and y-axes. A horizontal line or z-axis 138 also passes through the coordinate origin formed by the intersecting x- and y-axes. In the discussion which follows, it will be seen that the channeled masonry flashing 110 of this invention is constructed to completely cover the lowermost portion of the cavity, to drain water therefrom and to permit air and water vapor to enter and exit through channel openings 140 of flashing membrane 142. In this embodiment, the channeled masonry flashing 110 extends beyond the xy-plane of surface 132 and a water-shedding edging 133 is manually formed slanting downward and away from the exterior surface 132.

Referring now to FIG. 5 a perspective view of the channeled masonry flashing 110 is shown. A flexible membrane 142 is shown and is constructed from ethylene propylene dienemethylene terpolymer (EPDM) with recycled rubber additive material. The flexible membrane is embossed with channels 144 which extend from the cavity-side 145 of inner wythe 114 to a point slightly beyond exterior surface 132 of outer wythe 118. In this embodiment, the channels 144 terminate slightly beyond the exterior surface 132 of outer wythe 118 and are disposed transverse to longitudinal axis 150 of elongated flexible membrane 142.

As seen in FIGS. 4 and 5, the embossed flashing 142 has a scrim or protective member 152 disposed atop channel walls a54 and 156 for collecting mortar and construction debris dropped into the cavity and thereby preventing the blockage of the channels. The scrim or a mesh-like equivalent 152 is water permeable and allows water to drain along the channel beds 158 to the channel openings 140. Drainage is facilitated by, upon installation, slightly canting the flashing membrane 142 from back to front of cavity 122. The scrim 152 may be attached by welding, or adhesive application.

To form the water-shedding edging 133 several means have been found to overcome the plastic memory of flashing membrane 142. The edging may be provided with a metallized selvage or with a foil lamina—either metal or with a heat-treated margin. In this embodiment, a metal foil lamina 170 is shown and is coextensive with the flashing membrane 142. While the metal foil lamina may be selected from a wide range of metals including copper, aluminum, stainless steel, zinc, lead-coated copper, galvanized steel, and terne-coated and epoxy-coated metal foils, the foil lamina 170 of this embodiment is of copper. Upon installation the metal foil lamina 170 enables the installer to manually form the water-shedding edging 133 so that water exiting the drainage channel falls away from the exterior surface. The foil lamina 170 in this manner overcomes the memory of flexible membrane 142.

The adhesive layer 160 of the second embodiment is an admixture of a hot melt adhesive (adapted as described above for sufficient tack) and a butylated adhesive. The latter is present in the total mixture in the range of 5 to 40 percent. In the present case, a 75 percent hot melt adhesive and a 25 percent butylated adhesive mixture provides a non-drool adhesive layer 148 which, upon curing, has a melting point of 225 degrees F. This aspect, when the melting point is above 200 degrees F., satisfies the stability requirement.

Figure 7:
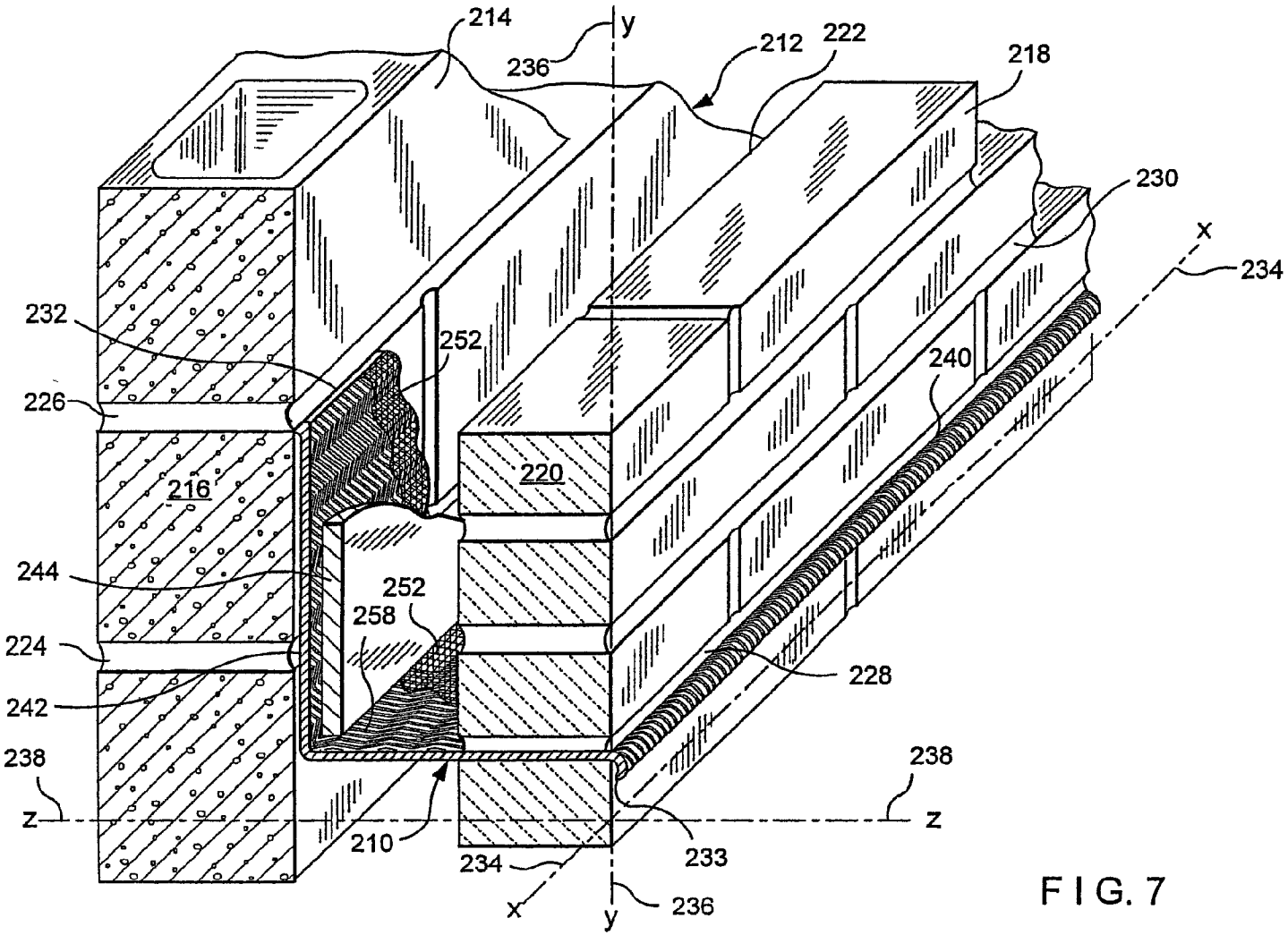
FIG. 7 is a perspective view of the third embodiment of the channeled masonry flashing of this invention and shows a cavity wall with an interior wythe of masonry blocks and an exterior wythe of brick having a surface-mounted channeled flashing membrane having a polymeric membrane with a scrim top and a filled reinforcing adhesive thereunder.
Figure 8:
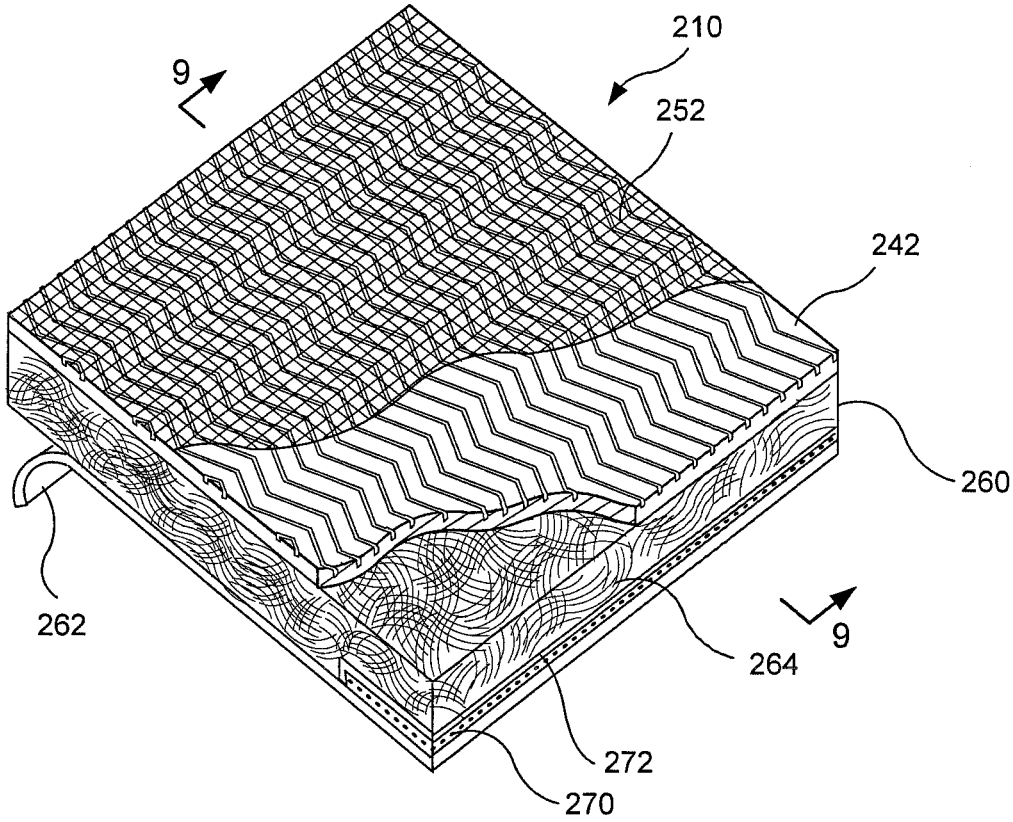
FIG. 8 is a perspective view of the creped channeled flashing membrane of FIG. 7 showing a metal edge; filled, reinforcing adhesive, and a release sheet.
Figure 9:
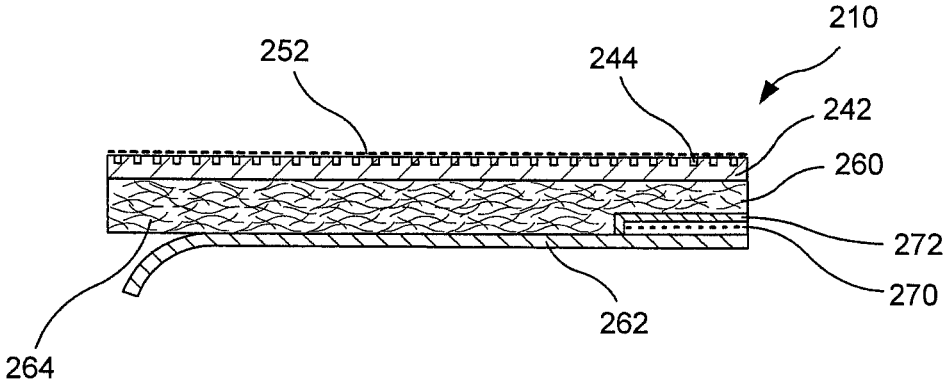
FIG. 9 is a cross-sectional view of the channeled flashing membrane of FIG. 8.

Referring now to FIGS. 7 through 9, the third embodiment of this invention in which a surface-mounted peel-and-stick channeled masonry flashing referred to generally by the reference designator 210, is shown. In this embodiment, similar parts to those of the first embodiment are referred to by reference designators 200 units higher than a similar part in the first embodiment. Thus, for example, the adhesive layer 60 in the first embodiment has an analogous adhesive layer 260 in the third embodiment.

In this embodiment, a cavity wall structure 212 is shown having an inner wythe 214 of masonry blocks 216 and an outer wythe 218 of facing brick 220. Between the inner wythe 214 and the outer wythe 218, a cavity 222 is formed. Successive bed joints 224 and 226 are formed between courses of blocks 216 and the joints are substantially planar and horizontally disposed. Also, successive bed joints 228 and 230 are formed between courses of bricks 220 and the joints are substantially planar and horizontally disposed. For the surface-mounted flashing installation of this embodiment the flashing 210 is shown extending up to bed joint 226 of the inner wythe 214 and into bed joint 228 of the outer wythe 218.

For purposes of this discussion, the exterior surface 232 of the outer wythe 218 contains a horizontal line or x-axis 234 and an intersecting vertical line or y-axis 236. A horizontal line or z-axis 238 also passes through the coordinate origin formed by the intersecting x- and y-axes. In the discussion which follows, it will be seen that the masonry flashing system 210 of this invention is constructed to completely cover the lowermost portion of cavity 22, to drain water therefrom and to permit air and water vapor to enter and exit through channel openings 240 of flashing membrane 242.

Across the cavity 222, in this embodiment, a surface-mounting of the masonry flashing is shown. The flashing 210 includes a channeled or creped membrane 242 constructed for emplacement on surface 232 of interior wythe 214 in an x-y plane and for extending across cavity 222 through bed joint 228. Membrane 242 is sulcated by crimping, impressing or pleating the polymeric web or sheet. The ribs or corrugations created thereby are transverse to the longitudinal axis of the web. The addition of a foil drip edge 233 renders the membrane 242 manually formable so that upon being turned downward the flashing retains the displaced position. Upon installation channeled flashing 210 is constructed to completely cover the lowermost portion of cavity 222. In this preferred mode, it is seen that the flashing membrane 242 is installed behind insulation 244.

In the third embodiment, an alternative flashing membrane for surface mounting in a cavity wall is shown. The flashing of the third embodiment is a creped high-density polyethylene (HDPE) membrane. In this instance, an integral drip edge 233 is attached to the adhesive layer 260 side of membrane 242. While the drip edge 233 hereof is a stainless steel foil laminated to the longitudinal margin of the membrane 242, any suitable water-shedding means such as a metallized selvage, a metal foil lamina, a plastic foil lamina or a heat-treated margin may be used. Among the metal foils for the water-shedding edging hereof are copper, aluminum, stainless steel, zinc, lead-coated copper, galvanized steel, and terne-coated and epoxy-coated metal foil. Similarly for metallizing the selvage copper, aluminum, steel, zinc and alloys thereof are suggested.

Referring now to FIGS. 8 and 9 the laminar structure of the uninstalled peel-and-stick channeled masonry flashing 242 is shown. The flashing 242, while provided as a surface-mounted flashing, is adaptable for through-wall mounting and utilizes the pressure-activated adhesive technology. The laminar structure consists of a six-layer arrangement. When viewing the uninstalled flashing 242 from the exposed surface and proceeding toward the mounted surface these layers are:

a. mortar collecting scrim 252;

b. creped, channeled membrane 242—HDPE—40-mil thick;

c. pressure-activated, reinforced hot-melt adhesive 260 doped with fiber fragments 264;

d. metal-foil edging 270—stainless steel;

e. foil adhesive—hot melt 272, (without tackifier of adhesive 260); and, e. release sheet 262 (preferably silicone treated).

The masonry flashing system of this invention exhibits temperature stability superior to that of bitumen materials and do not break down at high ambient temperatures. In addition, the bonding of hot melt adhesives is instantaneous as, upon pressure activation, hot melt adhesives set up immediately, and, thus, reduce the time required for installation. Independence from the bitumen-required ambient temperatures for cure purposes, translates into greater quality construction with greater reliability. Also, the combining of a mortar and construction debris collection device with a masonry flashing device as a single unit having the concomitant single installation effort is a great savings, of labor.

Figure 10:
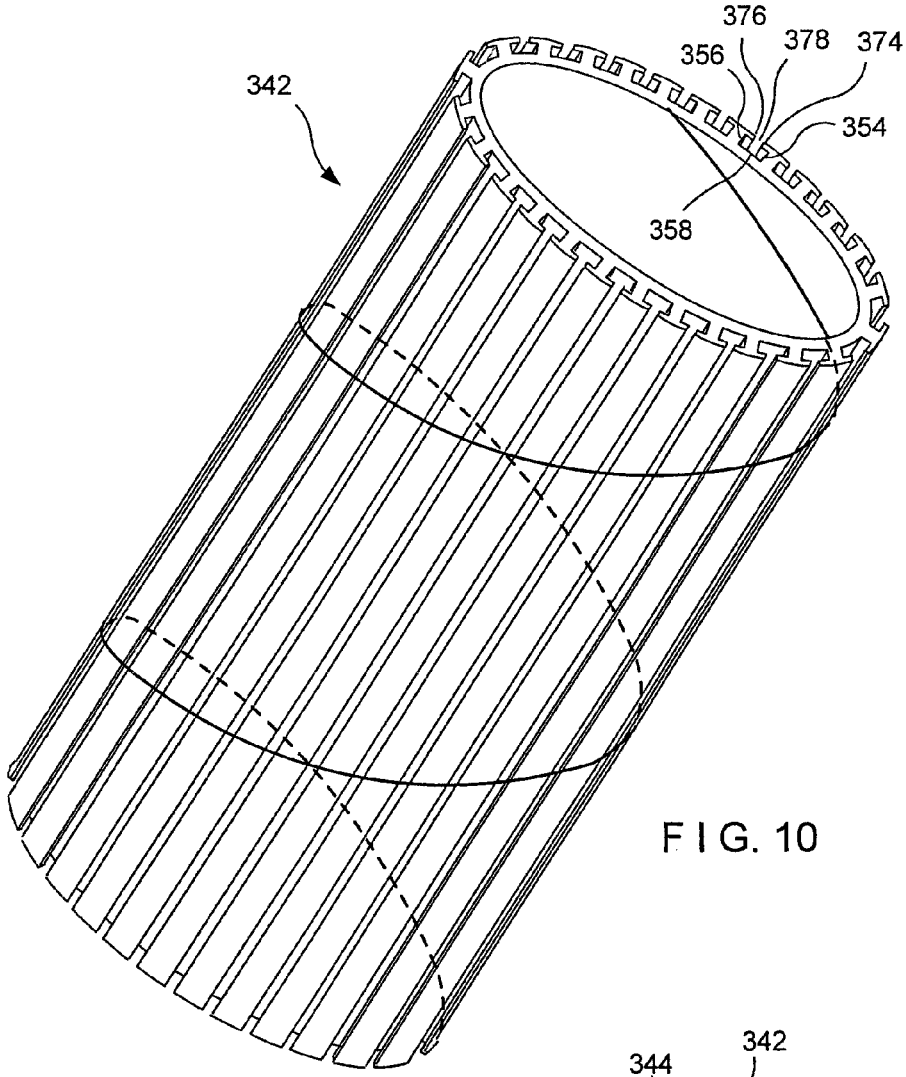
FIG. 10 is a perspective view of the fourth embodiment of the channeled masonry flashing of this invention and shows extruded tubular structure of the flashing before being cut into an elongated web; the unitary channeled flashing system with extruded channel portions therein and extruded protective members thereover.
Figure 11:
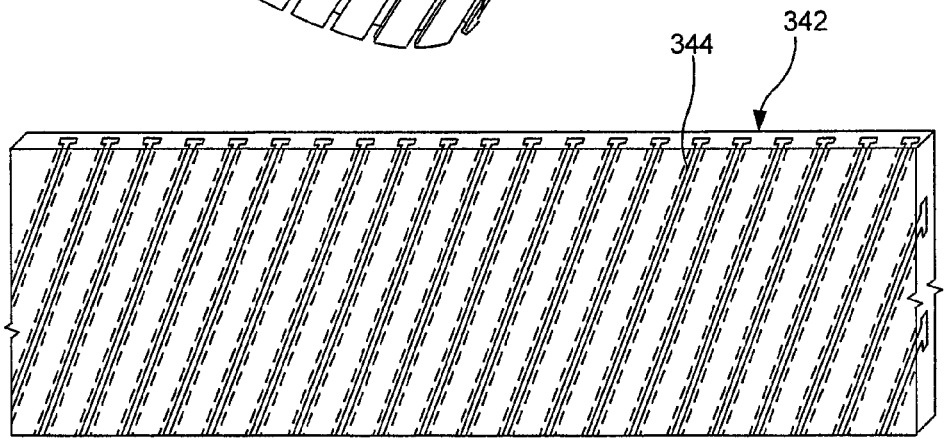
FIG. 11 is a perspective view of the extrudate being helically cut.

Referring now to FIGS. 10 and 11 a fourth embodiment of a channeled masonry flashing is shown and is referred to generally by the reference designator 342. The fourth embodiment describes the manner in which an elongated web of polymeric material is extrudable to include channels that are predominantly transverse to the longitudinal axis of the elongated flat web. In this embodiment, the protective member and the flashing are produced as a unitary body wherein the extruder forms extended channel walls overarching the channel bed.

As to reference designations, this embodiment follows the same protocol as described above, but concerns only the unitary flashing membrane 342 which includes the protective member 352. Here, a tubular body is sulcated so that the extruded ribs formed therein have walls 354 and 356 with wall extensions 374 and 376. When a flat web is made from the tubular extrusion, the wall extensions 374 and 376 are positioned overarching the channel bed 358 without totally closing the opening thereabove and leaving a slit 378 for water to enter or for gaseous fluids to pass through. The slits 378 are dimensioned to preclude the passage of mortar or construction debris.

The transverse characteristic of the channels 344 is achieved by helically cutting the tubular extrudate and forming an elongated membrane 342.

Figure 12:
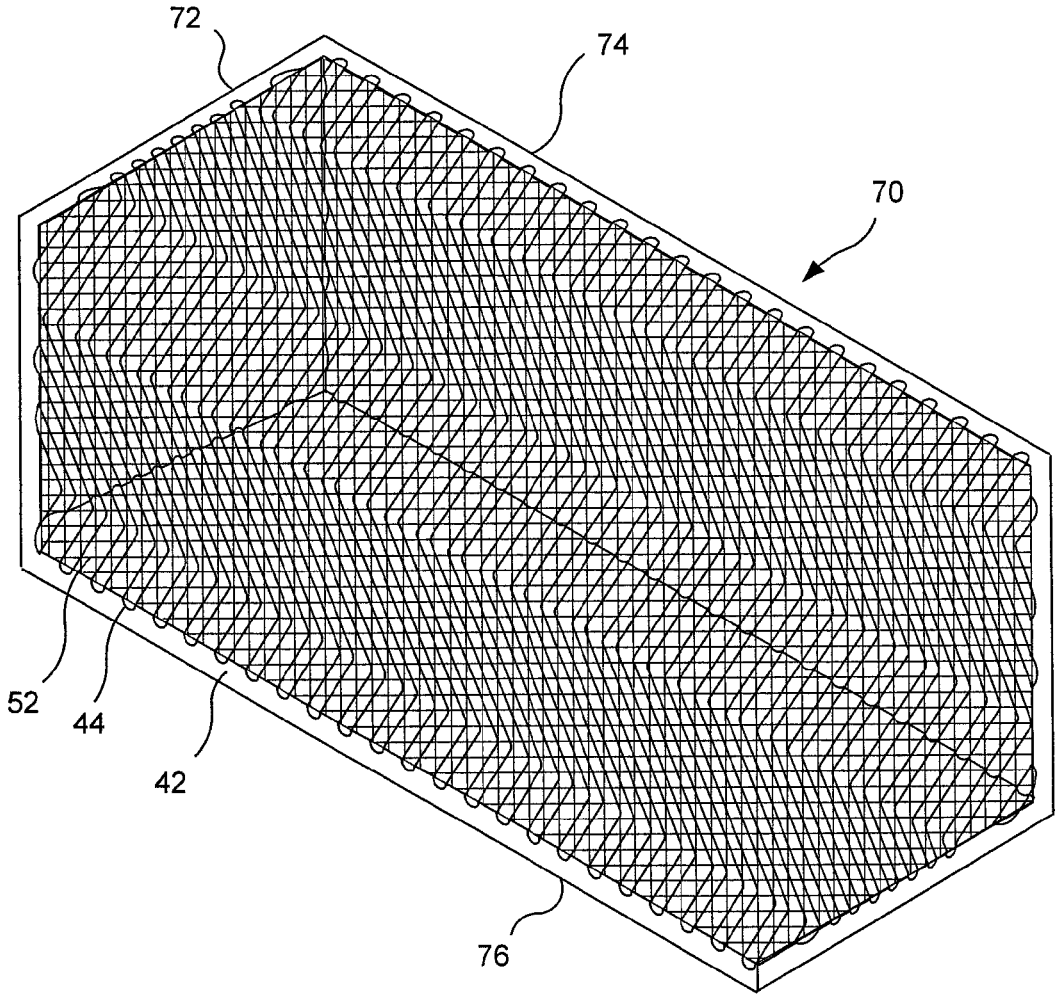
FIG. 12 is a perspective view of an end dam for use in conjunction with the channeled masonry flashing of the first embodiment.
Figure 13:
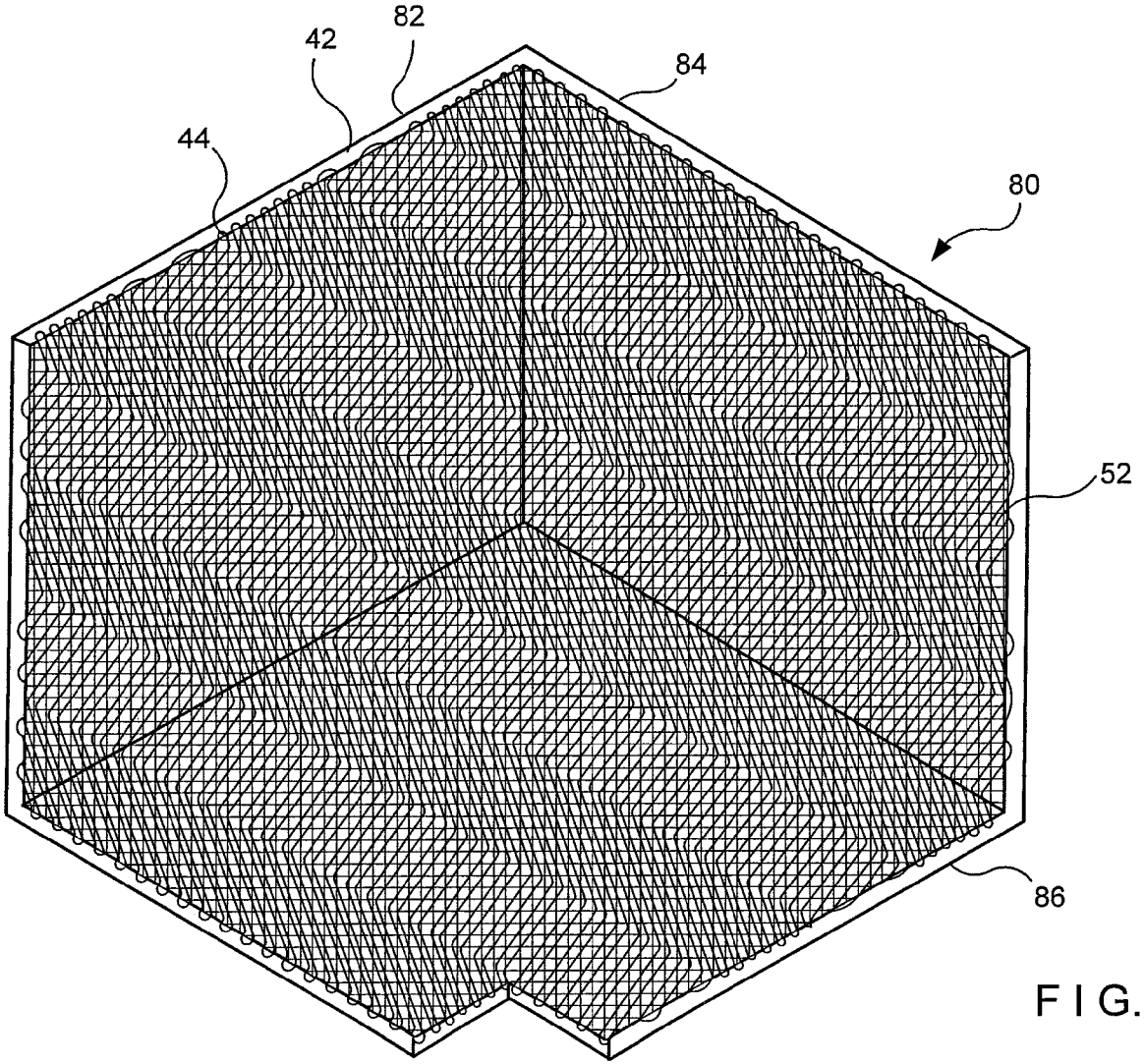
FIG. 13 is a perspective view of an inside corner for use in conjunction with the channeled masonry flashing of the first embodiment; and, FIG. 14 is a perspective view of an outside corner for use in conjunction with the channeled masonry flashing of the first embodiment.
Figure 14:
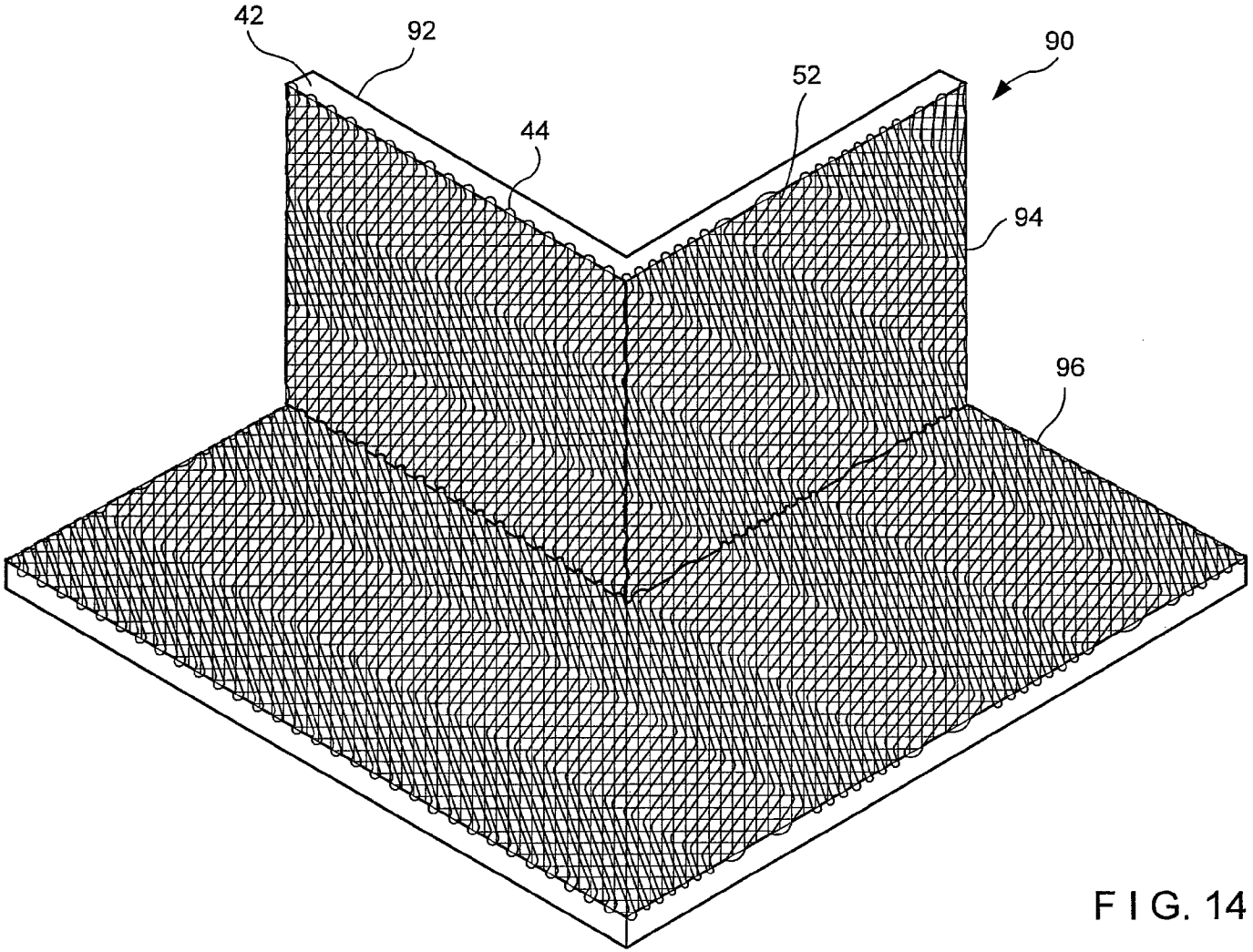

The above embodiments describe several forms of an elongated, channeled masonry flashing, which flashings may be accessorized by specially constructed end dams, inside corners and outside corners such as shown in FIGS. 12, 13 and 14, respectively. Although such accessories are contemplated for each embodiment, the FIGS. 12, 13 and 14 show the accessories for the first embodiment and employ reference designators continuous therewith. Constructing end dams, inside corners and outside corners for the remaining embodiments is considered, by extension, within the scope of the disclosure.

The flashing accessories hereof are installed in the cavity of the wall and at ends, at intersections with adjoining walls, or at outside corners. Each of the accessories are of three-part construction with two of the three panels or portions thereof being installed on the vertical wall surfaces and the remaining panel on the floor of the cavity.

Referring now to FIG. 12 and end dam 70 is formed from flexible membrane 42 and, as in the first embodiment, has channels 44 embossed therein with a scrim 52 thereover. The end dam 70 has a end cap 72 contiguous therewith and is positioned so that, upon installation, the assemblage is canted to drain water from the inner wythe 14 toward the outer wythe 18. As the wall portion 74 of end dam 70 and the floor portion 76 of end dam 70 are substantially identical, the end dam 70 is, upon rotation about both x- and y-axes, utilizable for both right-hand and left-hand applications.

Referring now to FIG. 13 an inside corner 80 is shown and is formed from flexible membrane 42. In contrast to end dam 70, while all the panel portions thereof are shown as being embossed, wall portions 82 and 84 may optionally be provided without embossing 44 or scrim 52. The inside corner 80 is, upon installation, positioned with the floor portion 86 in a canted manner to drain water from the inner wythe 14 toward the outer wythe 18. The inside corner 80 is dimensioned to serve both right-hand and left-hand applications.

Referring now to FIG. 14 an outside corner 90 is shown and is formed from flexible membrane 42. Similar to inside corner 80, wall portions 92 and 94 may optionally be provided without embossing 44 or scrim 52. The outside corner 90 is, upon installation, positioned with the floor portion 96 in a canted manner to drain water from the inner wythe 14 toward the outer wythe 18. The outside corner 90 is dimensioned to serve both right-hand and left-hand applications.

By the above embodiments, the best modes of practicing this invention have been described. While the examples are specific as to the flexible flashing membranes employed, variations can be made without departing from the spirit of the invention. The channeled masonry flashing of this invention enables the erector of a cavity wall to provide with one operation the usual flashing of the lowermost portion of the cavity and the device for mortar and construction debris collection.

What is claimed is:

1. A flashing for a cavity wall, said cavity wall having an inner wythe and an outer wythe with a cavity therebetween, said cavity wall having an exterior surface on the side of said outer wythe opposite said cavity, said flashing comprising in combination:

a sulcated polymeric membrane having an elongated body, two major surfaces and a longitudinal axis, said polymeric membrane selected from a group consisting of low density polyethylene, high density polyethylene, polyethylene teraphalate, polypropylene, styrene isoprene styrene, styrene ethylene butadiene styrene, styrene ethylene propylene, and admixtures thereof;

a plurality of channels having continuous and uninterrupted channel walls in at least one of said major surfaces of said polymeric membrane, each of said plurality of channels transverse said longitudinal axis and extending edge to edge of said polymeric membrane providing a conduit for air and water vapor to flow into and out of said cavity and for fluids to flow out of said cavity;

a protective member extending over at least a portion of each said plurality of channels precluding the blocking thereof by mortar droppings and construction debris, said protective member permitting water to flow into each of said plurality of channels;

an adhesive layer disposed on one of said major surfaces of said membrane; and, a release sheet disposed on said adhesive layer, said release sheet being removable prior to mounting said masonry flashing in said cavity of said cavity wall.

2. A flashing as described in claim 1 wherein said protective member is a scrim disposed atop said plurality of channels.

3. A flashing as described in claim 1 wherein said adhesive layer is a hot melt adhesive, said hot melt adhesive is a clear pressure-activated adhesive with a melting point, when cured, greater than 180° F., comprising about 10 to 50 percent by weight of a thermoplastic elastomer; about 5.5 to 10 percent by weight selected from a group consisting of ethylene, propylene, styrene, and mixtures thereof; about 20 to 50 percent of a tackifier resin; 15 to 50 percent by weight of an amorphous diluent; and, 0 to 2 percent by weight of a stabilizer.

4. A flashing for a cavity wall, said cavity wall having an inner wythe and an outer wythe with a cavity therebetween, said cavity wall having an exterior surface on the side of said outer wythe opposite said cavity, said flashing comprising in combination:

a sulcated flexible membrane having two major surfaces and a longitudinal axis, said sulcated flexible membrane comprising:

a plurality of channels having continuous and uninterrupted channel walls in at least one of said major surfaces of said flexible membrane, each of said plurality of channels transverse said longitudinal axis and coextensive with said flexible membrane, and extending continuously from said cavity to said exterior surface providing a conduit for air to flow into and out of said cavity and for water to flow out of said cavity;

a hot melt adhesive layer disposed on one of said major surfaces of said flexible membrane, said hot melt adhesive comprising about 10 to 50 percent by weight of a thermoplastic elastomer; about 5.5 to 10 percent by weight selected from a group consisting of ethylene, propylene, styrene, and mixtures thereof; about 20 to 50 percent of a tackifier resin; 15 to 50 percent by weight of an amorphous diluent; and, 0 to 2 percent by weight of a stabilizer;

a protective member extending over at least a portion of each said plurality of channels precluding the blocking thereof by mortar droppings and construction debris, said protective member permitting water to flow into each of said plurality of channels; and, a release sheet disposed on said adhesive layer, said release sheet being removable prior to mounting said flashing in said cavity of said cavity wall.

5. A flashing as described in claim 4 wherein said sulcated flexible membrane is selected from a group consisting of low density polyethylene, high density polyethylene, polyethylene teraphalate, polypropylene, styrene isoprene styrene, styrene ethylene butadiene styrene, styrene ethylene propylene, and admixtures thereof.

6. A flashing as described in claim 5 wherein said tackifier resin is selected from a group consisting of hydrogenated wood rosin, rosin ester, polyterpene resins, and aliphatic petroleum hydrocarbon resins.

7. A flashing as described in claim 6 wherein said protective member is a scrim disposed atop said plurality of channels.

* * * * *